US011851903B2

(12) United States Patent
Sun et al.

(10) Patent No.: US 11,851,903 B2
(45) Date of Patent: Dec. 26, 2023

(54) FOLDING CANOPY WITH AN AUTOMATIC OPENING AND CLOSING CENTER SMALL-ROOF STRUCTURE

(71) Applicant: ZHEJIANG JIANSHENG LEISURE PRODUCTS CO., LTD, Zhejiang (CN)

(72) Inventors: Yuanru Sun, Zhejiang (CN); Jian He, Zhejiang (CN); Weijun Xu, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 305 days.

(21) Appl. No.: 17/413,956

(22) PCT Filed: Apr. 14, 2021

(86) PCT No.: PCT/CN2021/087112
§ 371 (c)(1),
(2) Date: Jun. 15, 2021

(87) PCT Pub. No.: WO2022/213408
PCT Pub. Date: Oct. 13, 2022

(65) Prior Publication Data

US 2023/0058332 A1 Feb. 23, 2023

(30) Foreign Application Priority Data

Apr. 8, 2021 (CN) ..... 202120719614.0

(51) Int. Cl.
*E04H 15/50* (2006.01)

(52) U.S. Cl.
CPC ..... *E04H 15/50* (2013.01)

(58) Field of Classification Search
CPC ..... E04H 15/50; E04H 15/16
See application file for complete search history.

(56) References Cited

U.S. PATENT DOCUMENTS 6,598,614 B2 * 7/2003 Liu ..... E04H 15/50 135/131
6,708,707 B2 * 3/2004 Dotterweich ..... E04H 15/50 135/159

(Continued)

FOREIGN PATENT DOCUMENTS

CN 2828223 10/2006
CN 204609457 9/2015

(Continued)

*Primary Examiner* — David R Dunn
*Assistant Examiner* — Danielle Jackson
(74) *Attorney, Agent, or Firm* — JCIP GLOBAL INC.

(57) ABSTRACT

Disclosed is a folding canopy with an automatic opening and closing center small-roof structure, the folding canopy includes a plurality of canopy leg tubes and a folding canopy frame located above the canopy leg tubes. The folding canopy frame comprises a plurality of canopy struts, one end of each canopy strut is hingedly coupled to a center roof disk, a small-roof upper disk member is provided above the center roof disk, a small-roof lower disk member is provided below the center roof disk, a elevating rod is provided between the small-roof lower disk member and the small-roof upper disk member, and the small-roof lower disk member is movable vertically along with the opening and closing of the folding canopy, so that the small-roof upper disk member is movable vertically by the driving of the elevating rod.

14 Claims, 13 Drawing Sheets

(56) References Cited

U.S. PATENT DOCUMENTS

| | | | | |
|---|---|---|---|---|
| 6,718,995 | B2 * | 4/2004 | Dotterweich | E04H 15/50 135/117 |
| 7,240,686 | B2 * | 7/2007 | Seo | E04H 15/50 135/159 |
| 9,995,058 | B2 * | 6/2018 | Jin | G08C 17/02 |
| 10,041,272 | B2 * | 8/2018 | Choi | E04H 15/50 |
| 10,246,898 | B2 * | 4/2019 | Jin | E04H 15/46 |
| 2004/0084074 | A1 * | 5/2004 | Chiu | E04H 15/50 135/131 |

FOREIGN PATENT DOCUMENTS

| | | | | |
|---|---|---|---|---|
| CN | 205531639 | | 8/2016 | |
| CN | 207260738 | | 4/2018 | |
| CN | 108518121 | | 9/2018 | |
| CN | 208280719 | | 12/2018 | |
| CN | 209067000 | U * | 7/2019 | |
| CN | 209908072 | | 1/2020 | |
| CN | 211286916 | | 8/2020 | |
| CN | 212295870 | | 1/2021 | |
| KR | 200364603 | Y1 * | 6/2004 | |
| KR | 20060122187 | A * | 5/2005 | |
| WO | WO-2007147301 | A1 * | 12/2007 | E04H 15/50 |

* cited by examiner

FOLDING CANOPY WITH AN AUTOMATIC OPENING AND CLOSING CENTER SMALL-ROOF STRUCTURE

CROSS-REFERENCE TO RELATED APPLICATION

This application is a 371 of international application of PCT application serial no. PCT/CN2021/087112, filed on Apr. 14, 2021, which claims the priority benefit of China application no. 202120719614.0, filed on Apr. 8, 2021. The entirety of each of the above mentioned patent applications is hereby incorporated by reference herein and made a part of this specification.

BACKGROUND

Technical Field

The invention relates to the technical field of a folding canopy, in particular to a folding canopy with an automatic opening and closing center small-roof structure.

Description of Related Art

The alias of the folding canopy is an advertising canopy and an awning. It can be used for outdoor exhibitions and product promotion, celebration evenings, exhibitions, tourism, leisure, field work, food stalls. It can also be used for song and dance evenings and other temporary activities, as well as long-term leisure facilities in the park tourist resort scenic area. In a folding canopy, because it needs to be folded and unfolded, the inner center roof is usually designed as a single roof structure, and the roof is a sealed structure, which can not realize the internal air circulation and affects the overall use stability of the folding canopy.

To this end, a double-roof folding canopy roof is disclosed in publication of CN205531639U, which includes a folding lower canopy frame and a lower roof tarpaulin. The lower roof tarpaulin covers the lower roof frame and is fixedly connected with the lower roof frame and the middle opening, the folding upper canopy frame is movably connected to the lower canopy frame, and the upper roof tarpaulin covers the upper canopy frame and is fixedly connected with it. However, when the canopy is unfolded, the folding upper canopy frame with this structure is relatively poor in integral unfolding, and the swinging between the folding upper canopy and the lower canopy frame is prone to occur, which leads to poor supporting effect of the center canopy roof. Meanwhile, the unfolding of this structure and the assembly of components are relatively complicated, resulting in relatively poor overall use effect.

In addition, after the existing folding canopy is folded, its overall volume is relatively large due to the interference of the internal folding canopy, which affects the packaging size. In addition, the center canopy roof of the existing folding canopy with double roofs is usually limited by the structure, which leads to its relatively small overall covering area and can not be adjusted according to the demand. For the existing upper roof tarpaulin, after the upper canopy frame is folded, the upper canopy frame usually continuously expands outward to the upper roof tarpaulin, which causes the upper roof tarpaulin to be in a tension state continuously, and during long-term use, it is prone to cause the upper roof tarpaulin to be over-stretched, and when the folding canopy is opened, the upper roof tarpaulin covering the folding canopy is prone to collapse, affecting the appearance.

At the same time, the opening and closing mode of the existing folding canopy with a double-roof structure usually needs to be performed by multiple people, which causes the overall opening and closing operation to be troublesome and affects the use effect.

SUMMARY

The object of the present invention is to provide a folding canopy with an automatic opening and closing center small-roof structure, which is used for solving the above technical problems, and facilitate the realization of the double-roof opening and closing of the folding canopy. At the same time, it can be combined with a center lock to facilitate the opening and closing of the folding canopy, and has the characteristics of simple structure, low manufacturing cost and good universality.

The technical problems solved by the invention can be realized by the following technical schemes.

A folding canopy with an automatic opening and closing center small-roof structure includes a plurality of canopy leg tubes and a folding canopy frame located above the canopy leg tubes. The folding canopy frame comprises a plurality of canopy struts, and one end of each canopy strut is hingedly coupled to a center roof disk. A small-roof upper disk member is provided above the center roof disk, a small-roof lower disk member is provided below the center roof disk, a elevating rod is provided between the small-roof lower disk member and the small-roof upper disk member, and the small-roof lower disk member is movable vertically along with the opening and closing of the folding canopy, so that the small-roof upper disk member is movable vertically by the driving of the elevating rod.

In one of the preferred embodiments, the folding canopy further includes a plurality of linkage rods. One ends of the linkage rods are hingedly coupled to the small-roof lower disk member, the other ends of the linkage rods are hingedly coupled to the canopy struts, and each linkage rod is used in cooperation with a respective one of the canopy struts.

In one of the preferred embodiments, the elevating rod has a single rod structure, and is mounted to cooperate with a center of the small-roof lower disk member, a center of the center roof disk is provided with an elevating hole, and the elevating rod penetrates the elevating hole and is fixedly installed at a center of the small-roof upper disk member.

In one of the preferred embodiments, a slotted hole is provided in a middle portion of the small-roof lower disk member, and a bottom end of the elevating rod is embedded in the slotted hole and fixed by a fastener.

In one of the preferred embodiments, the slotted hole has a blind hole structure.

In one of the preferred embodiments, the folding canopy further includes a center lower disk member. The center lower disk is located below the small-roof lower disk member, and the elevating rod penetrates a first through hole at the center of the small-roof lower disk member and extends downwards, and a bottom end of the elevating rod is capable of being locked with the center lower disk.

In one of the preferred embodiments, the elevating rod is fixedly coupled to the small-roof lower disk member through a fastener, and the small-roof lower disk member is capable of driving the elevating rod to move vertically along with the opening and closing of the folding canopy, such that the small-roof upper disk member is movable vertically by the driving of the elevating rod.

In one of the preferred embodiments, the elevating rod comprises at least two elevating rod units, bottom ends of the elevating rod units are fixedly installed with the small-roof lower disk member, roof ends of the elevating rod units are fixedly installed with the small-roof upper disk member, and the center roof disk is provided with a plurality of elevating holes, and each elevating rod unit penetrates through a respective one of the elevating holes and is disposed in one-to-one correspondence.

In one of the preferred embodiments, a plurality of mounting holes are provided in the small-roof lower disk member, and each mounting hole is configured for cooperatively fitting with a respective one of the elevating rod units.

In one of the preferred embodiments, the folding canopy further includes a center lower disk. The center lower disk is located at a lower part of the small-roof lower disk member, and a center locking rod is fixedly installed on the center roof disk, and penetrates through a second through hole at a center of the small-roof lower disk member and extends downwards, and a bottom end of the center locking rod is capable of being locked with the center lower disk.

In one of the preferred embodiments, a plurality of elevating rod units surround an outer side of the center locking rod, and the small-roof lower disk member slides up and down along the center locking rod during opening and closing with the folding canopy.

In one of the preferred embodiments, the canopy struts are respectively provided with canopy roof corner pieces, and the canopy roof corner pieces are configured for supporting edges of a small roof tarpaulin.

In one of the preferred embodiments, each of the canopy roof corner pieces comprises a first sidewall, a second sidewall and an upper wall, a groove is formed between the first sidewall, the second sidewall and the upper wall, an opening of the groove faces downward, and the groove is configured for being embedded with a canopy strut.

In one of the preferred embodiments, the first sidewall and the second sidewall are triangular structures.

In one of the preferred embodiments, a bottom corner of the first sidewall and a bottom corner of the second sidewall are hingedly coupled to a respective one of the canopy struts.

In one of the preferred embodiments, the canopy roof corner pieces are inclined outward and upward relative to a center of the folding canopy.

Based on any of the above embodiments, preferably, an upper end of the center roof disk is provided with an embedding groove, and the embedding groove is configured for being embedded and installed with the small-roof upper disk member.

Based on the above embodiments, preferably, a locking groove is provided in the small-roof lower disk member, and the locking groove is configured in cooperation with a fastener, and the fastener penetrates through the locking groove and is fixed with the elevating rod.

Compared with the prior art, the present invention has the following outstanding advantages and effects. According to the present invention, the opening and closing of the folding canopy is utilized, through optimized design, to drive the canopy struts to move by the small-roof lower disk member and the elevating rod, so that the elevating of the small-roof upper disk member is realized, and the unfolding of the small roof tarpaulin is completed with the canopy roof corner pieces, thereby realizing the automatic opening and closing of the double roofs of the folding canopy. In addition, the optimized structure can be used with the existing center lock structure to achieve reduced manufacturing cost and good universality.

The features of the present invention can be clearly understood by referring to the drawings and the following detailed description of preferred embodiments.

DESCRIPTION OF THE EMBODIMENTS

Figure 1:
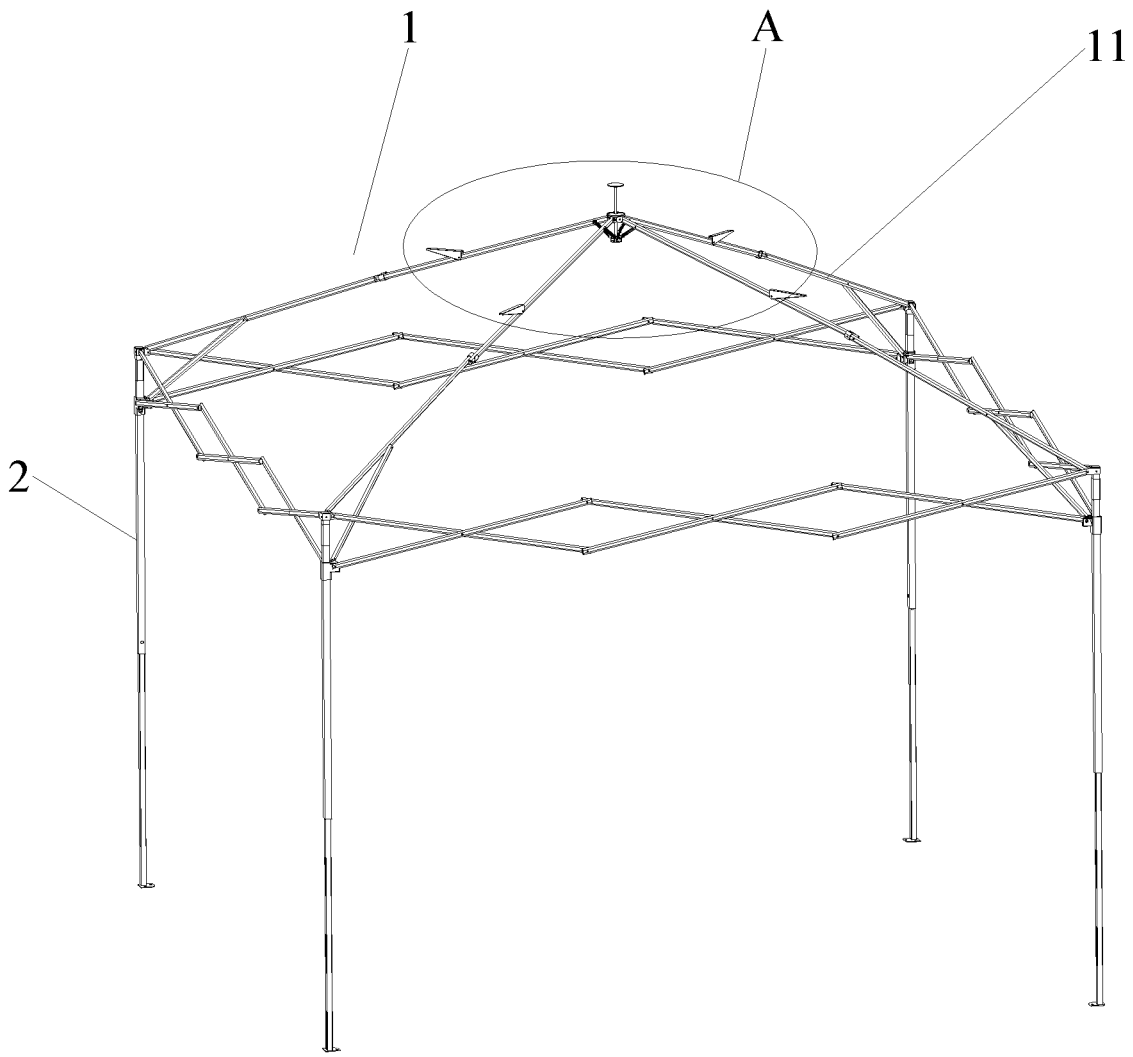
FIG. 1 is a structural schematic diagram I of an unfolded state of the present invention.
Figure 2:
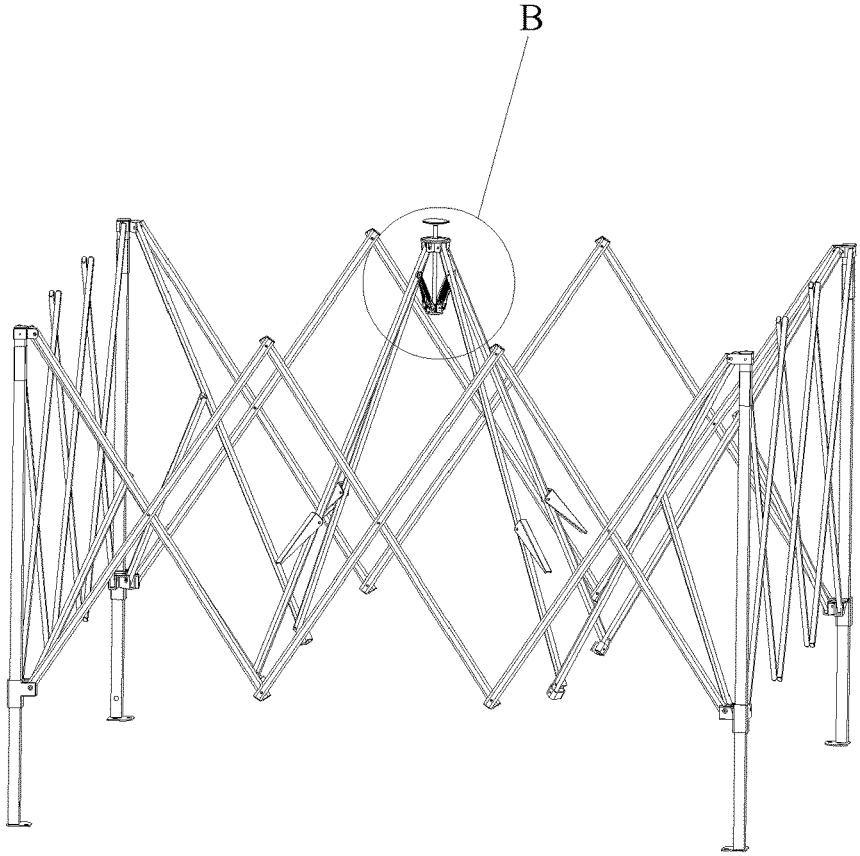
FIG. 2 is a structural schematic diagram I of a semi-unfolded state of the present invention.
Figure 3:
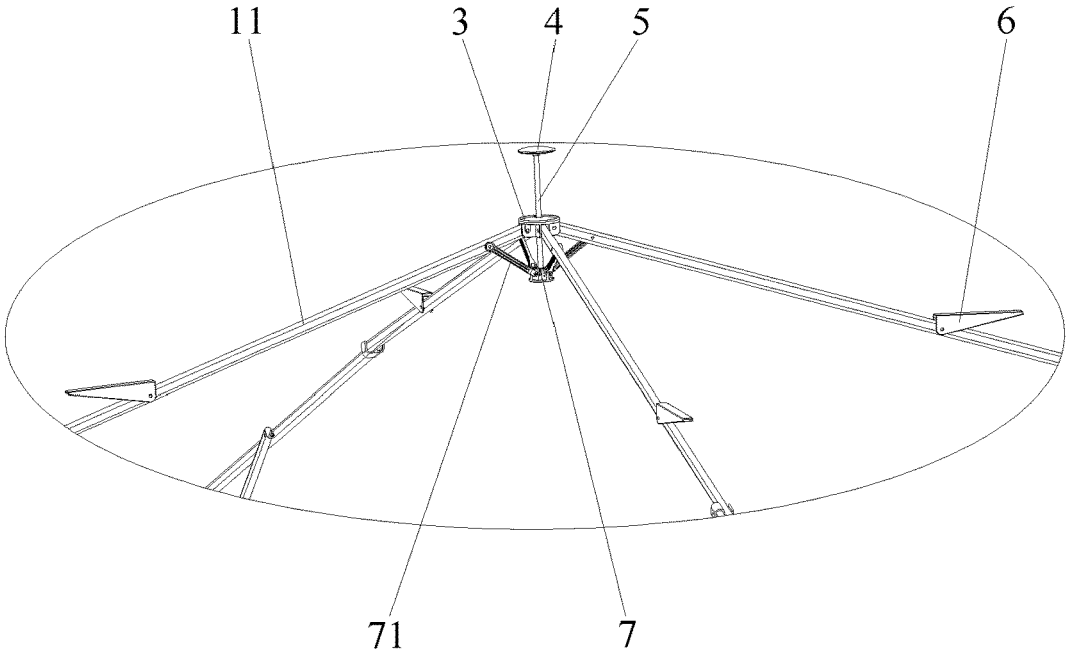
FIG. 3 is a partially enlarged structural diagram of part A in FIG. 1.
Figure 4:
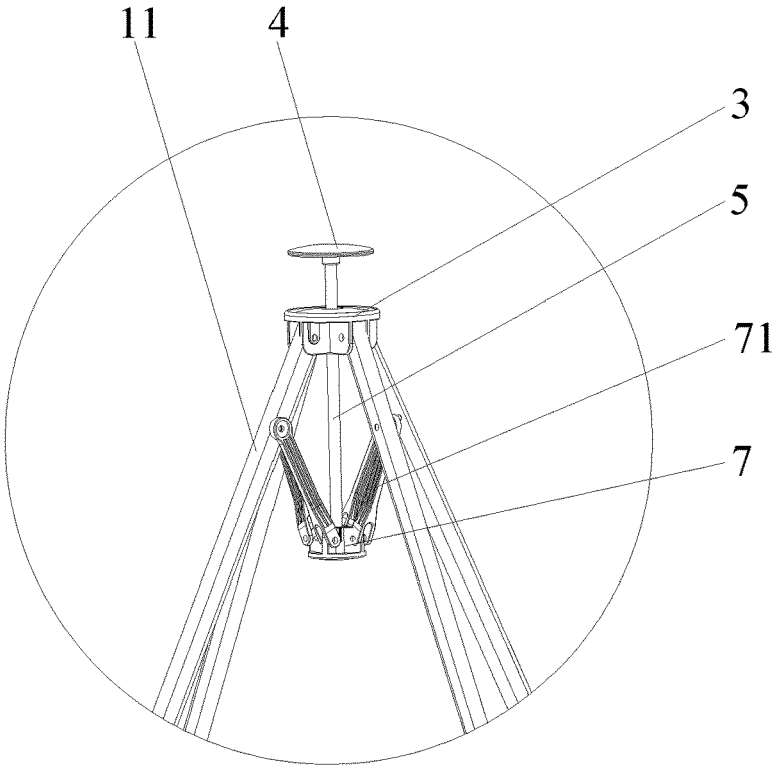
FIG. 4 is a partially enlarged structural diagram of part B in FIG. 2.
Figure 5:
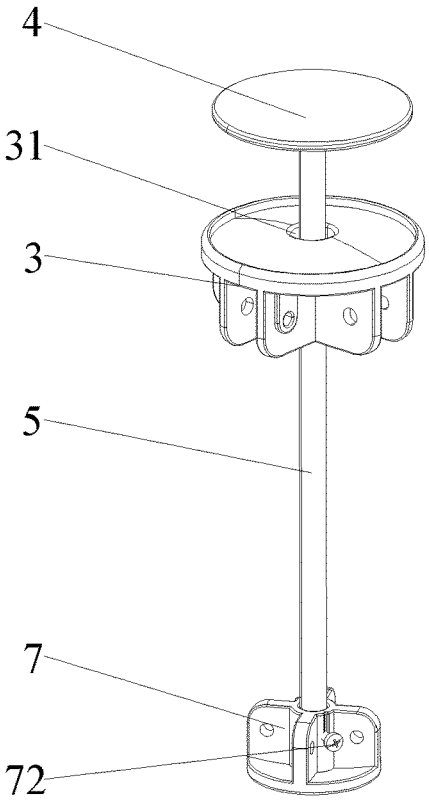
FIG. 5 is a structural schematic diagram I of a center small-roof of the present invention.
Figure 6:
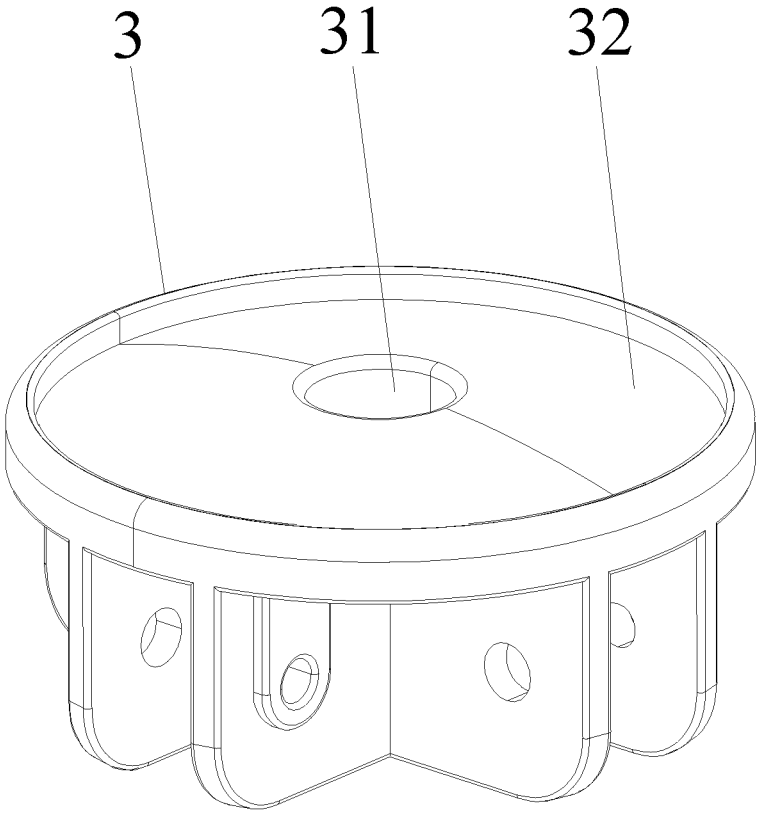
FIG. 6 is a structural schematic diagram I of a center roof disk of the present invention.
Figure 7:
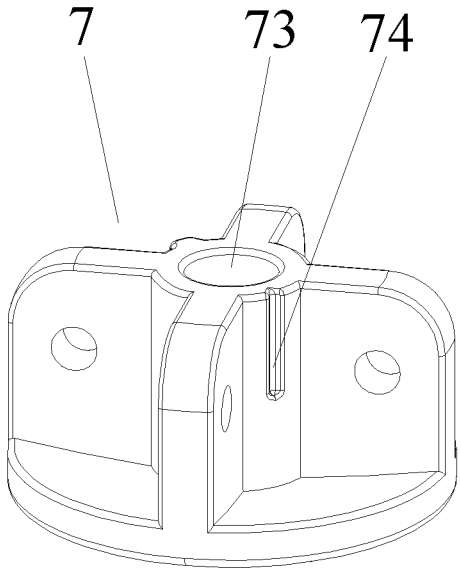
FIG. 7 is a structural schematic diagram of a small-roof upper disk member of the present invention.
Figure 8:
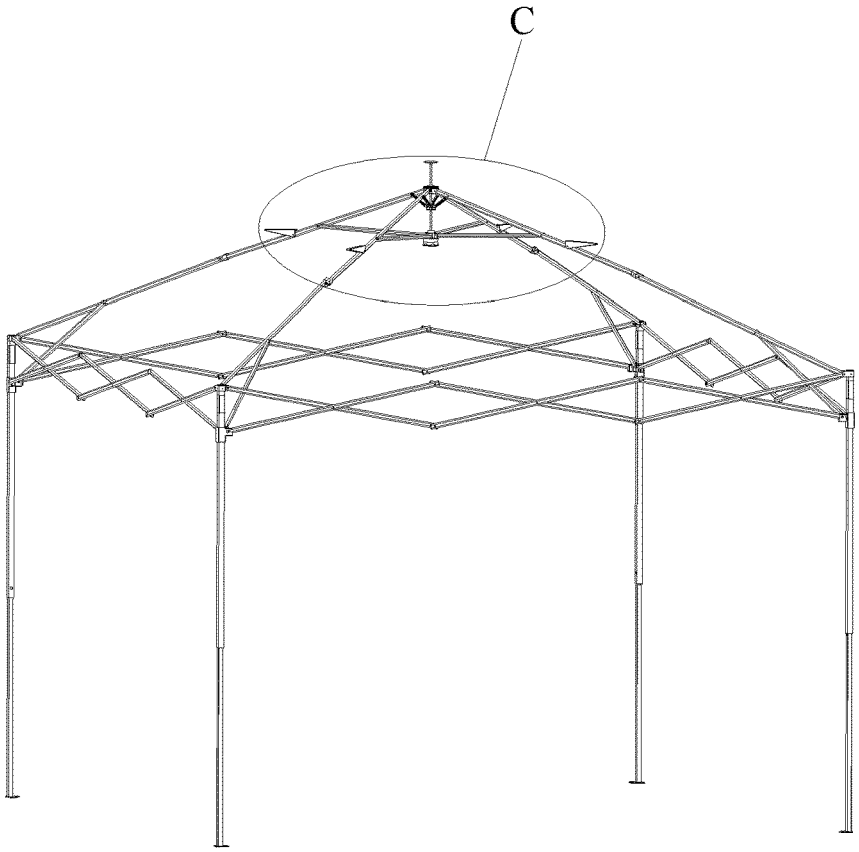
FIG. 8 is a structural schematic diagram II of the unfolded state of the present invention.
Figure 9:
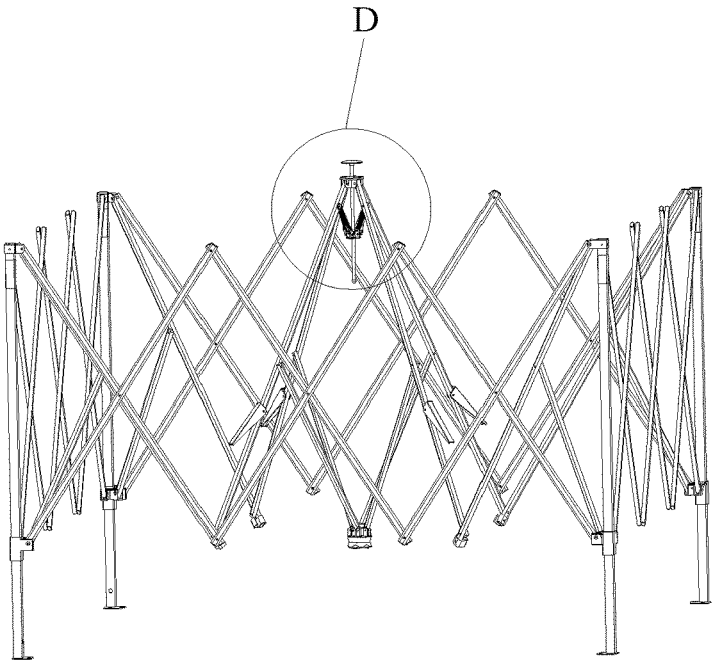
FIG. 9 is a structural schematic diagram II of the semi-unfolded state of the present invention.
Figure 10:
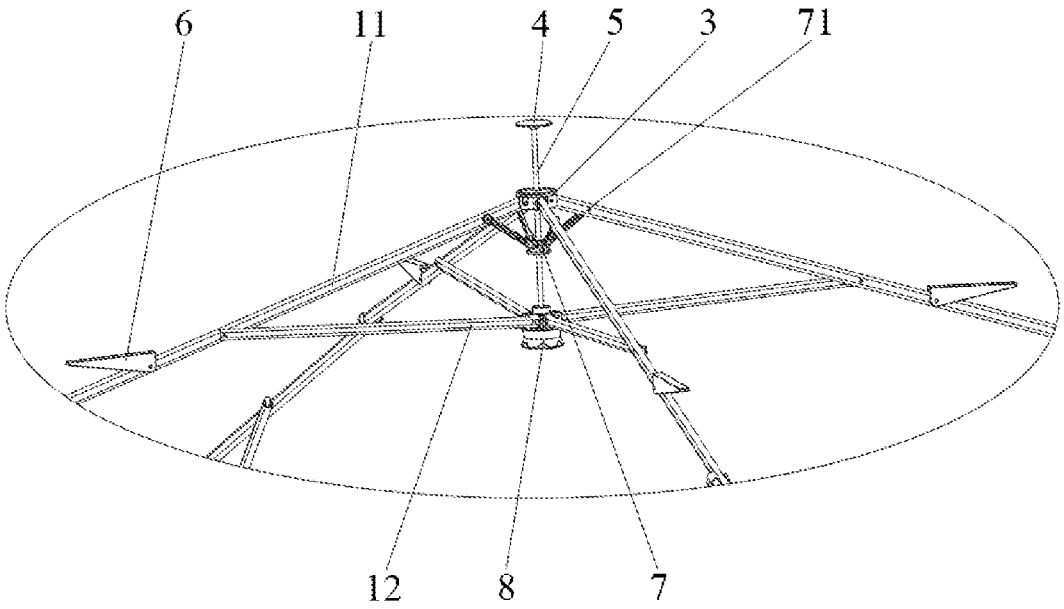
FIG. 10 is a partially enlarged structural diagram of part C in FIG. 8.
Figure 11:
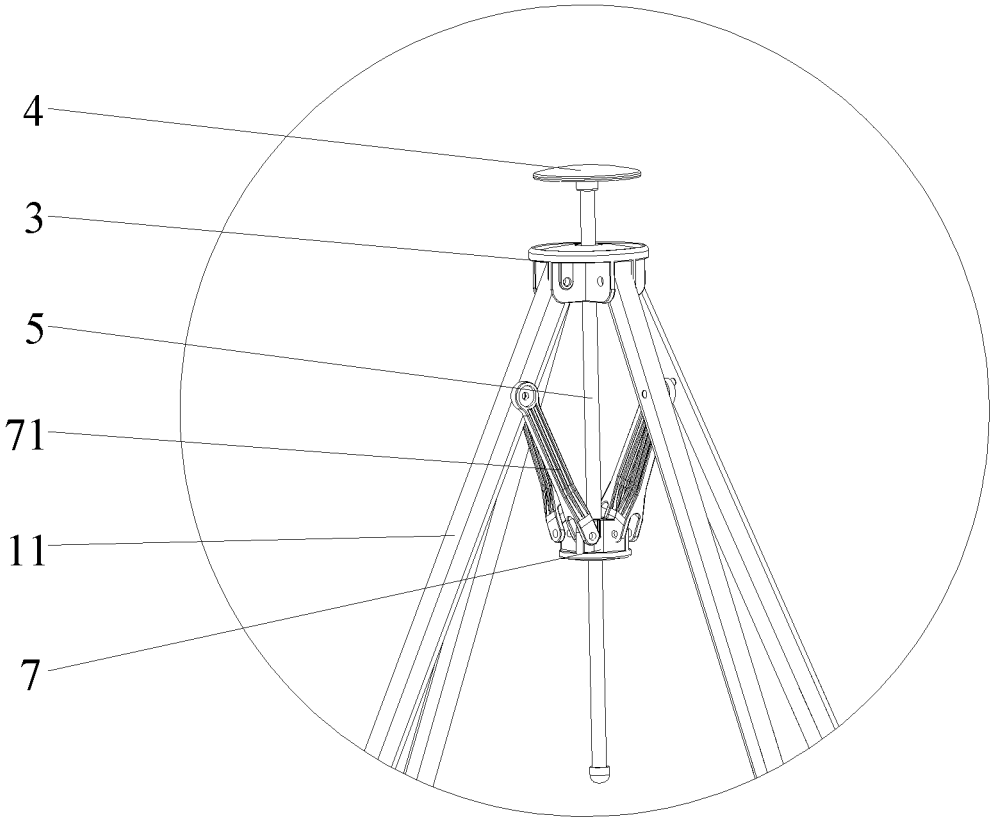
FIG. 11 is a partially enlarged structural diagram of part D in FIG. 9.
Figure 12:
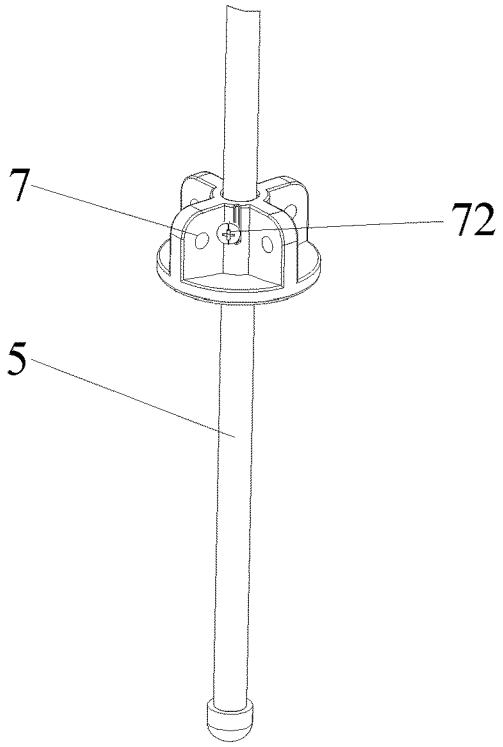
FIG. 12 is a structural schematic diagram of the installation of an elevating rod and the small-roof upper disk member of the present invention.
Figure 13:
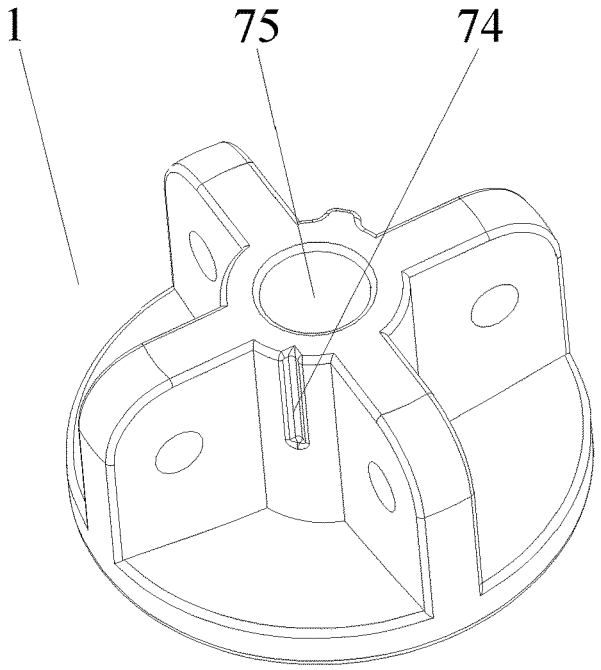
FIG. 13 is a structural schematic diagram II of the small-roof upper disk member of the present invention.
Figure 14:
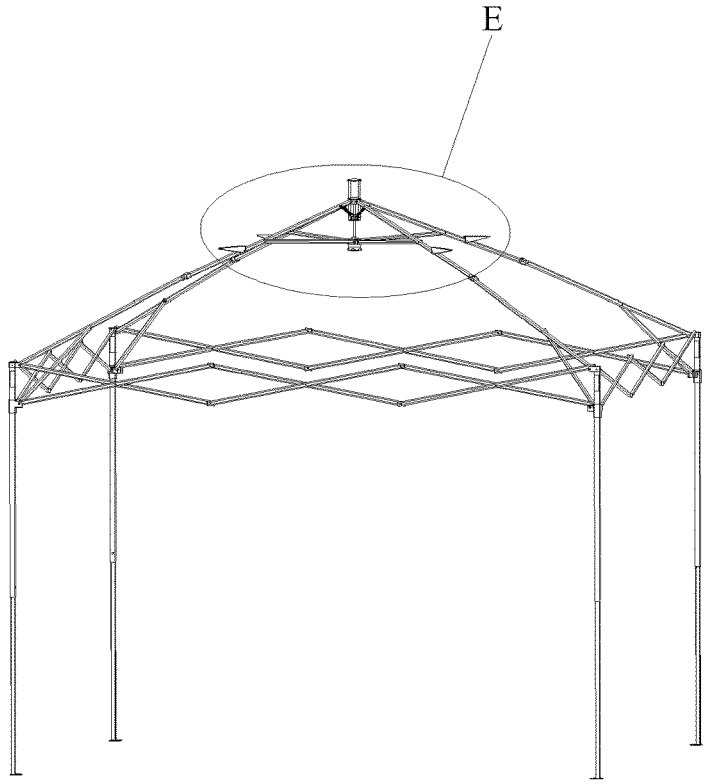
FIG. 14 is a structural schematic diagram III of the unfolded state of the present invention.
Figure 15:
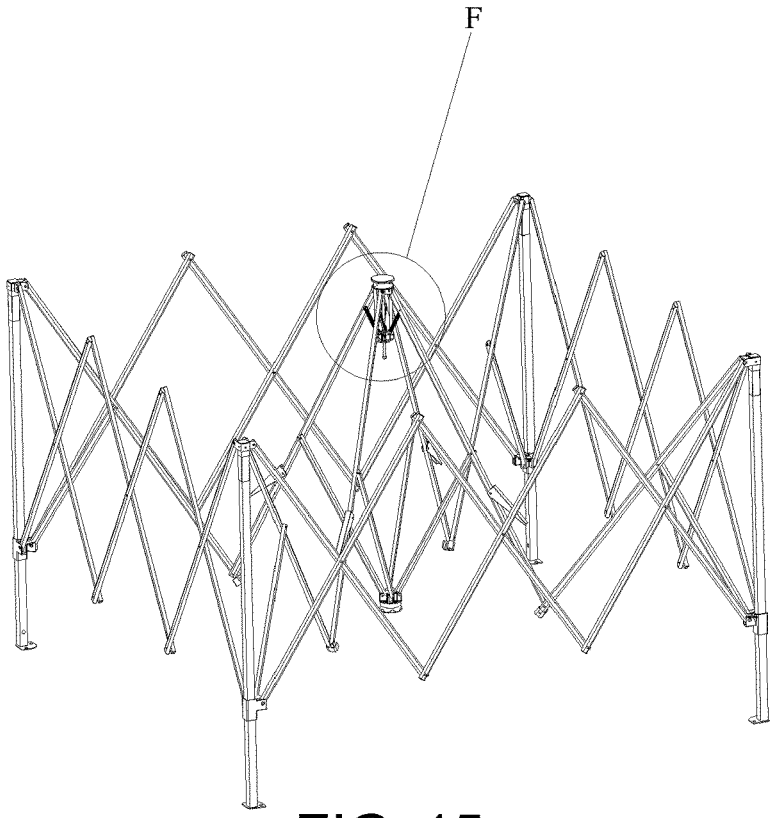
FIG. 15 is a structural schematic diagram III of the semi-unfolded state of the present invention.
Figure 16:
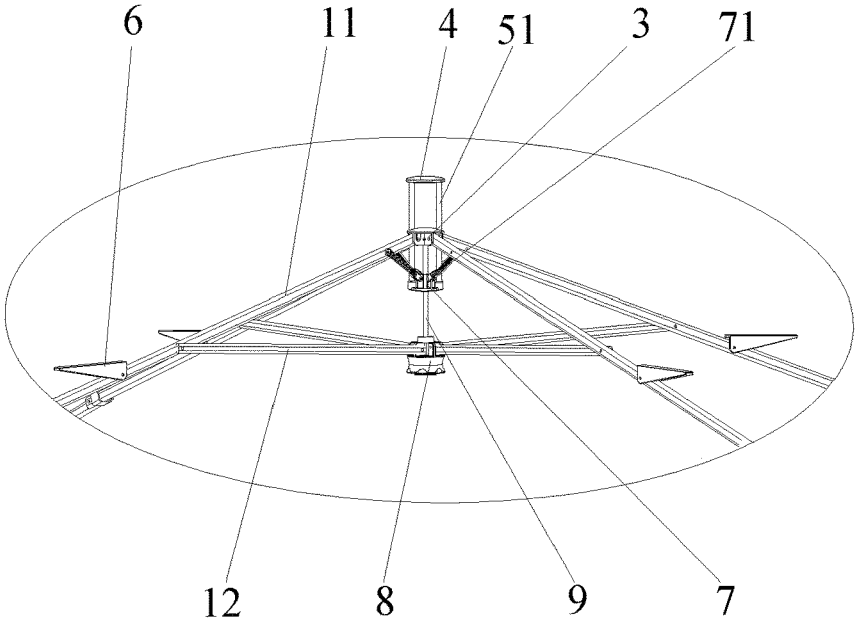
FIG. 16 is a partially enlarged structural schematic diagram of part E in FIG. 14.
Figure 17:
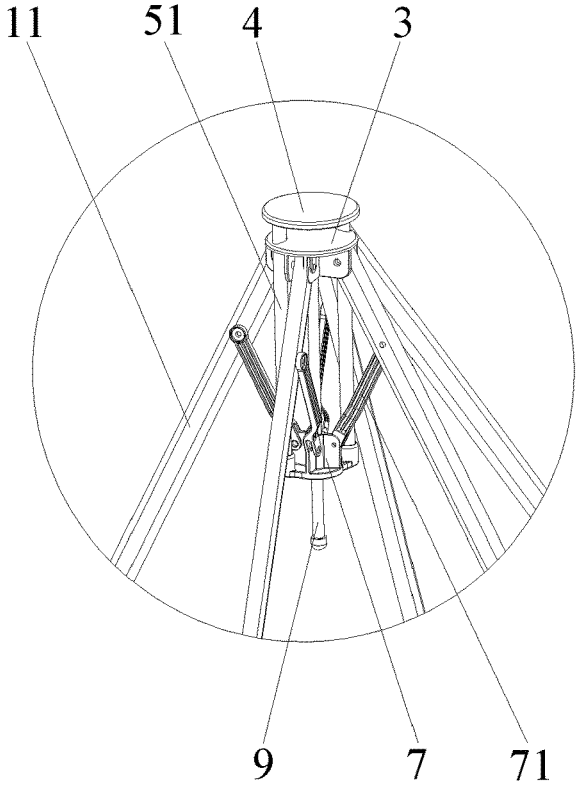
FIG. 17 is a partially enlarged structural schematic diagram of part F in FIG. 15.
Figure 18:
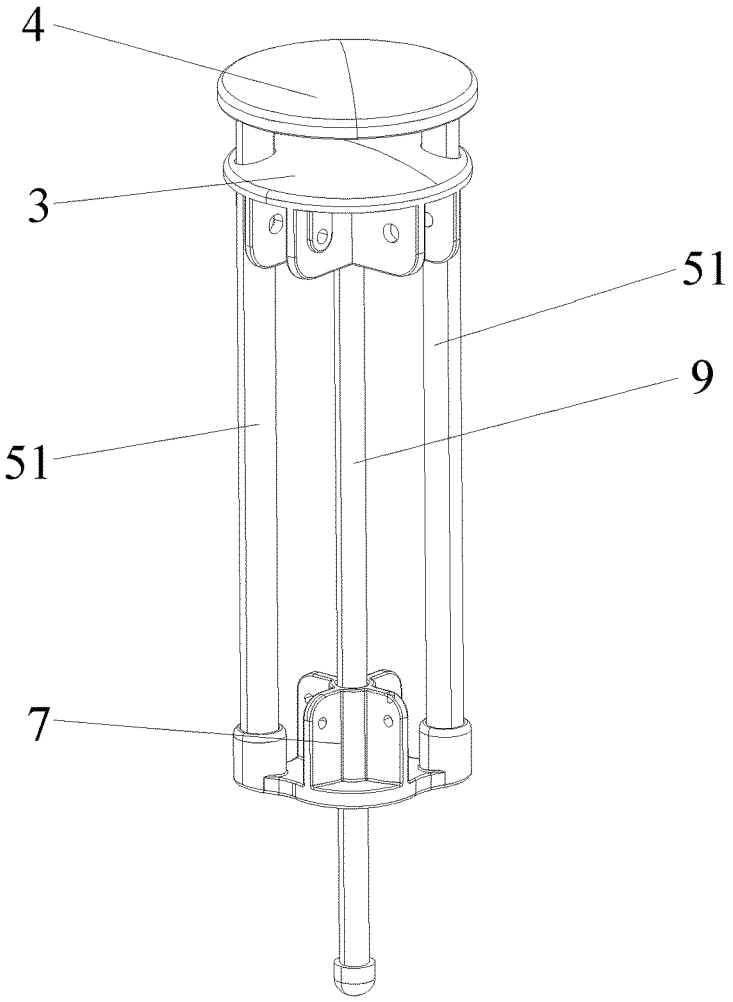
FIG. 18 is a structural schematic diagram II of the center small-roof of the present invention.
Figure 19:
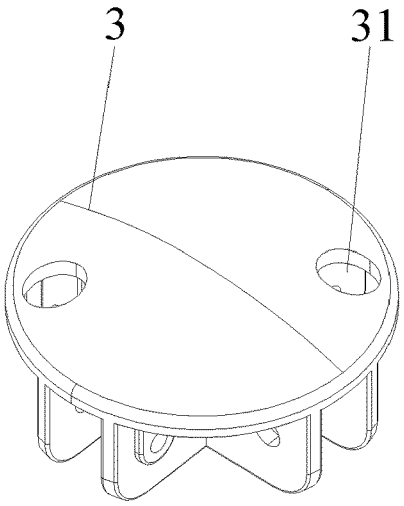
FIG. 19 is a structural schematic diagram II of the center roof disk of the present invention.
Figure 20:
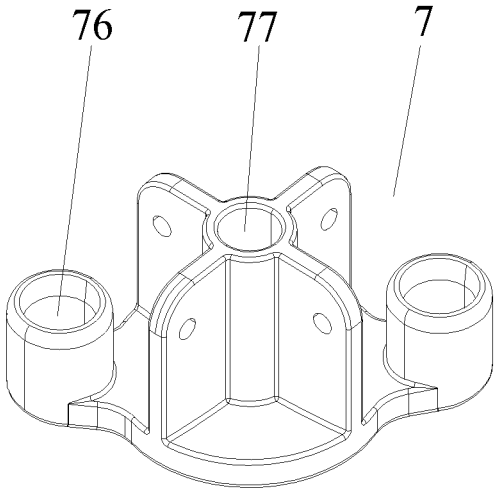
FIG. 20 is a third structural schematic diagram III of the small-roof upper disk member of the present invention.

In order to make the technical means, creative features, achievement goals and effects achieved by the present invention easy to understand, the present invention will be further described below in cooperation with specific illustrations.

In the description of the present invention, it should be understood that the terms indicating orientation or positional relations such as "center", "longitudinal", "transverse", "upper", "lower", "front", "rear", "left", "right", "vertical", "horizontal", "roof", "bottom", "inner", "outer" are based on the orientation or positional relations shown in the drawings. At the same time, the description of the specific positional relations in the description is only for the convenience of describing the present invention and simplifying the description, rather than indicating or implying that the device or element referred to must have a specific orientation, a specific orientation structure and operation, and therefore cannot be understood as limiting the present invention. Similarly, similar words such as "a", "first", "one" or "the" do not mean any quantity limitation, but mean that there is at least one.

Embodiment 1

As shown in FIG. 1 to FIG. 24, a folding canopy with an automatic opening and closing center small-roof structure provided by the present invention includes a plurality of canopy leg tubes 2 and a folding canopy frame 1 located above the canopy leg tubes 2. The folding canopy frame 1 includes a plurality of canopy struts 11, and one end of each canopy strut 11 is hingedly coupled to a center roof disk 3. The main structure of the folding canopy is a common structure in the prior art, reference can be made to the specific folding canopy structure disclosed in publication of CN108518121A or the specific folding canopy structure disclosed in publication of CN204609457U.

Specifically, in the folding canopy, each of the canopy leg tubes 2 also include a sliding seat which can move along the canopy leg tubes 2 and a roof seat at a top portion of the canopy leg tubes 2. The adjacent canopy leg tubes 2 are hingedly coupled to each other through folding rods to form a hinge group, and are respectively hingedly coupled to the sliding seats and the roof seats to realize cooperative mounting. In addition, each canopy strut 11 usually includes two or more canopy strut units, preferably two, and the canopy strut units are hingedly coupled to each other. An outer end of each of the canopy struts 11 is hingedly coupled to the roof seat and an inner end of each of the canopy struts 11 is hingedly coupled to the center roof disk 3. Each of the canopy struts 11 can be folded. The canopy strut units at the outer ends are usually coupled to inclined rods, respectively, one end of each inclined rod is hingedly coupled to the canopy strut unit fitted with it, and the other end of each inclined rod is hingedly coupled to the slide seat. Among them, the following-mentioned linkage rods 71 and short struts 12 are installed in cooperation with the canopy strut units hingedly coupled to the center roof disk 3 at the inner side. One end of each of the short struts 12 is hingedly coupled to a respective one of the canopy strut units, and the other end of each of the short struts 12 is hingedly coupled to a center lower disk member 8.

In this preferred embodiment, the disclosed automatic opening and closing center small-roof structure includes a small-roof upper disk member 4, an elevating rod 5 and a small-roof lower disk member 7. The small-roof upper disk member 4 is located above the center roof disk 3, usually at direct upper part, and the small-roof lower disk member 7 is located below the center roof disk 3, usually at direct lower part. An elevating rod 5 is provided between the small-roof lower disk member 7 and the small-roof upper disk member 4, and the small-roof lower disk member 7 is movable vertically along with the opening and closing of the folding canopy, such that the small-roof upper disk member 4 is movable vertically by the driving of the elevating rod 5.

In one of the preferred embodiments, the upper end of the center roof disk 3 is provided with an embedding groove 32, and the embedding groove 32 is used for being embedded and installed with the small-roof upper disk member 4, which can enhance the overall aesthetic appearance.

In a specific embodiment, the canopy includes a plurality of linkage rods 71, and the number of the linkage rods 17 is consistent with that of canopy struts 11, usually four. There may be eight canopy struts in individual folding canopies, for example, in the folding canopy structure disclosed in publication of CN209908072U, the number of linkage rods 71 can be four or eight, which is usually fitted with the canopy struts 11 fitted with the roof seat. One ends of the linkage rods 71 are hingedly coupled to the small-roof lower disk member 7, and the other ends are hingedly coupled to the canopy struts 11, and a single linkage rod 71 is coupled to a single canopy strut 11. Optimizing the structural design can make the folding canopy drive the small-roof lower disk member 7 to move in the opening and closing changing state. Specifically, when the folding canopy moves from the folded state to the unfolded state, each canopy leg tube 2 is separated from each other, so that the sliding seat on the canopy leg tubes 2 moves upwards, driving the canopy struts 11 in the folded state to start to unfold to the straight state. The canopy struts 11 constantly change and unfold outwards with the center roof disk 3 as the center, such that the linkage rods 71 change from the vertical state to the horizontal state, so as to drive the small-roof lower disk member 7 to move from the low position to the high position, and then drive the elevating rod 5 to move upwards, and that the small-roof upper disk member 4 moves from close to the center roof disk 3 to far away from the center roof disk, so that the small-roof upper disk member 4 continuously moves upward until the whole folding canopy is unfolded; otherwise, it is folded.

Embodiment 2

Based on embodiment 1 and as shown in FIG. 1 to FIG. 13, in this preferred embodiment, the elevating rod 5 has a single rod structure, which is mounted to cooperate with the center of the small-roof lower disk member 7. The center roof disk 3 is provided with an elevating hole 31, and the elevating rod 5 penetrates through the elevating hole 31 and is fixedly installed with the center of the small-roof upper disk member 4. Among them, a slotted hole 73 is formed in the middle of the small-roof lower disk member 7, which is a blind hole structure. The blind hole structure facilitates the cooperative mounting of the elevating rod and enhances the aesthetic appearance. The bottom end of the elevating rod 5 is embedded in the slotted hole 73 and fixed by a fastener 72, which is usually a screw, and can also be a fixing pin.

Preferably, a locking groove 74 is formed on the small-roof lower disk member 7, and the locking groove 74 is used in cooperation with a fastener 72, and the fastener 72 penetrates through the locking groove 74 to be fixed with the elevating rod 5.

As shown in FIG. 1 to FIG. 6, this preferred embodiment is generally applicable for folding canopies without center lock structure. A center roof disk 3 is provided in the middle of the folding canopy, which is used in cooperation with a small-roof upper disk member 4, an elevating rod 5 and a small-roof lower disk member 7. When the folding canopy moves from a folded state to an unfolded state, based on the opening and closing principle of the folding canopy in embodiment 1, the small-roof disk 7 is driven to move upwards along with the movement of the linkage rods 71, so that the elevating rod 5 continuously moves upward along the elevating hole 31. This structural design can be applied to a folding canopy without a center lock structure.

Embodiment 3

Based on Embodiment 2, as shown in FIG. 7 to FIG. 13, the folding canopy in this embodiment can be used in cooperation with the folding canopy with a center lock structure in the prior art. Specifically, it further includes a center lower disk member 8 located below the small-roof lower disk member 7, and the center lower disk member 8, the center roof disk 3 and the elevating rod 5 are combined to form a center lock structure, and the elevating rod 5 penetrates through the first through hole 75 at the center of the small-roof lower disk member 7 and extends downward. The bottom end of the elevating rod 5 can be locked with the center lower disk member 8. For the specific center lock structure, please refer to publication of CN208280719U, CN207260738U, CN212295870U and CN211286916U. Among them, the elevating rod 5 has the same function as the center rod in the center lock, and the elevating rod 5 is used as a common component, which has relatively lower cost and simpler and more effective structure. In addition, in this embodiment, the center lower disk member 8 usually needs to be provided with short struts 12 and canopy struts 11 to realize hinged fitting, the lower end of the elevating rod 5 can be separated from the center lower disk member 8, and the elevating rod 5 and the small-roof lower disk member 7 are fixedly fitted by a fastener 72. The small-roof lower disk member 7 is capable of driving the elevating rod 5 to move vertically along with the opening and closing of the folding canopy, so that the small-roof upper disk member 4 is movable vertically by the driving of the elevating rod.

Embodiment 4

Based on embodiment 1 and as shown in FIG. 14 to FIG. 20, in this preferred embodiment, the elevating rod 5 includes at least two elevating rod units 51, the bottom ends of the elevating rod units 51 are fixedly installed with the small-roof lower disk member 7, and the roof ends of the elevating rod units 51 are fixedly installed with the small-roof upper disk member 4. Preferably, the small-roof lower disk member 7 is provided with a plurality of mounting holes 76, and each mounting hole 76 is configured for cooperatively mounting with a respective one of the elevating rod units 51. A plurality of elevating holes 31 are provided on the center roof disk 3, and each elevating rod unit 51 penetrates through a respective one of the elevating holes 31 and is disposed in one-to-one correspondence. In this embodiment, preferably, the number of elevating rods 5 can be 2, 3 or 4, and when the number of elevating rods 5 is 2, they are usually symmetrically provided on both sides, when the number of elevating rods 5 is 3, they are usually provided at three vertex angles of a regular triangle, and when the number of elevating rods 5 is 4, they are usually provided at four corners of a square. This structural design can be applied to a folding canopy without a center lock structure.

In this embodiment, when the folding canopy is unfolded outward from a folded state, the opening and closing principle of the folding canopy in Embodiment 1 is combined, in which the elevating rod unit 51 is driven to continuously move upward along the elevating holes 31 as the small-roof lower disk member 7 gradually moves from bottom to roof, so that the small-roof upper disk member 4 moves upward.

Embodiment 5

Based on Embodiment 4, as shown in FIG. 14 to FIG. 20, the folding canopy in this embodiment can be used in cooperation with the folding canopy with a center lock structure in the prior art. Specifically, the folding canopy includes a center lower disk member 8 located below the small-roof lower disk member 7, and a center locking rod 9 is fixedly installed on the center roof disk 3. The center locking rod 9 penetrates through the second through hole 77 in the center of the small-roof lower disk member 7 and extends downward, and the bottom end of the center locking rod 9 can be locked with the center lower disk member 8. The center lower disk member 8, the center roof disk 3 and the center locking rod 9 are combined to form a center lock structure. For the center lock structure, please refer to the specific prior art center lock structure in Embodiment 3. When the small-roof lower disk member 7 opens and closes with the folding canopy, it slides up and down along the center locking rod 9, and the automatic opening and closing of the small-roof can be realized by using the plurality of elevating rod units 51 surrounding the outer side of the center locking rod 9. For the arrangement design of the plurality of elevating rod units 51, please refer to Embodiment 4.

In this embodiment, with the unfolding of the folding canopy, the center lower disk member 8 and the small-roof lower disk member 7 move upward from the bottom at the same time, wherein the center lower disk member 8 continuously moves upward and completes the locking matching with the center locking rod 9.

After the small-roof lower disk member 7 continuously moves upward, the small-roof lower disk member 7 moves along the center locking rod 9 and is combined with the elevating holes 31 on the center roof disk 3, so that the elevating rod units 51 move upward and the small-roof upper disk member 4 moves upward.

Embodiment 6

Figure 21:
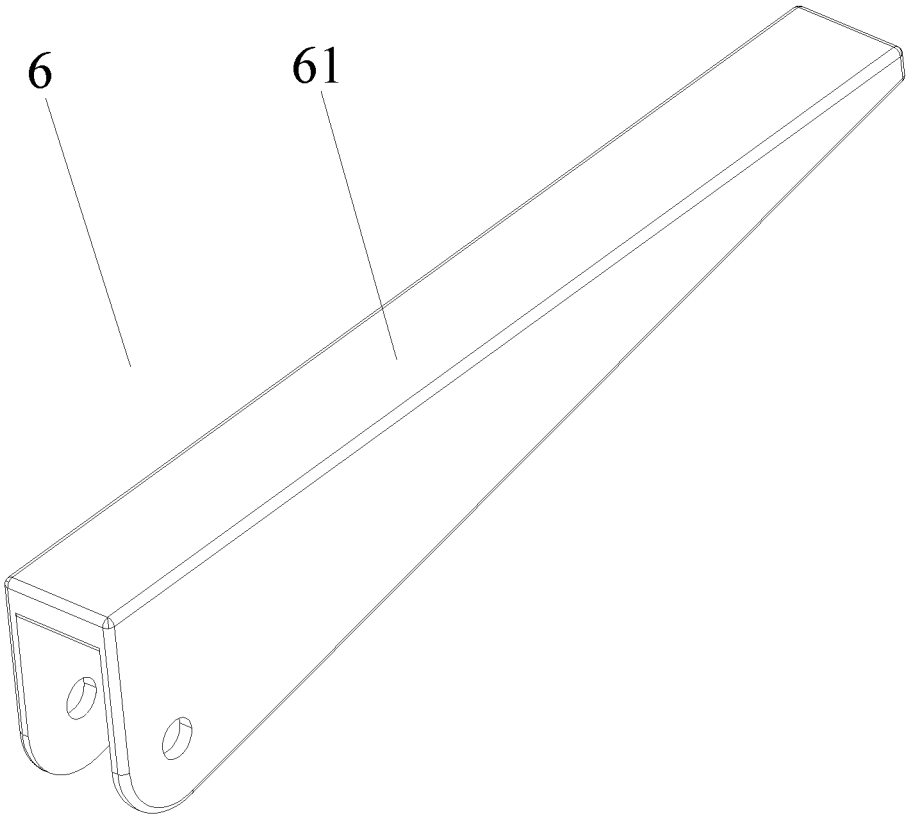
FIG. 21 is a structural schematic diagram I of canopy roof corner pieces of the present invention.
Figure 22:
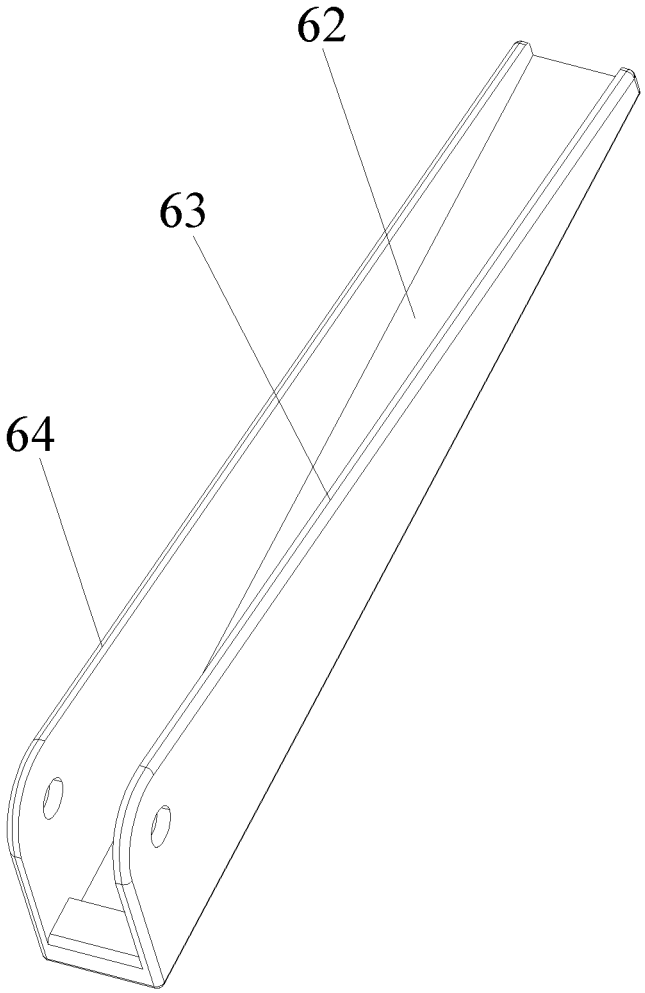
FIG. 22 is a structural schematic diagram II of the canopy roof corner pieces of the present invention.
Figure 23:
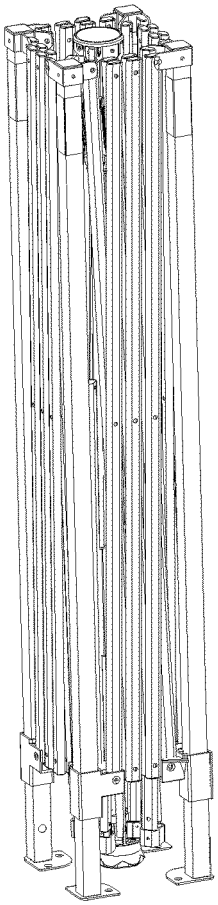
FIG. 23 is a structural schematic diagram of the unfolded state of the canopy with tarpaulin of the present invention.
Figure 24:
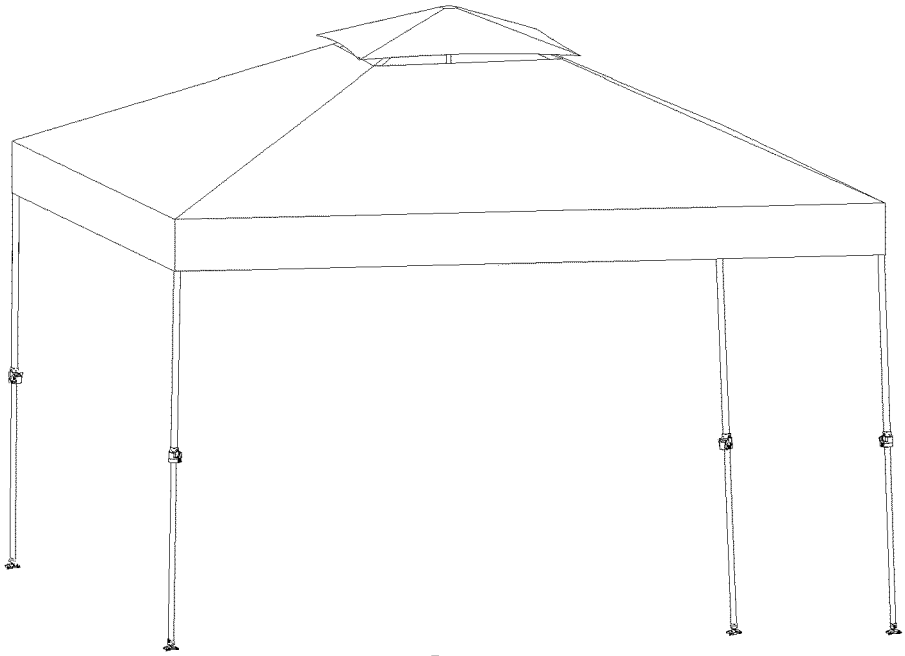
FIG. 24 is a structural diagram of a folded state of the present invention.

Based on any of the above embodiments, as shown in FIG. 21 and FIG. 22, the canopy struts 11 are further provided with canopy roof corner pieces 6 used to support the edges of the small roof tarpaulin. Each of the canopy roof corner pieces 6 includes a first sidewall 63, a second sidewall 64 and an upper wall 61, and a groove 62 is formed between the first sidewall 63, the second sidewall 64 and the upper wall 61, and the opening of the groove 62 faces downward for embedding with the rod body of the canopy strut 11. The structural design is to reduce the volume of components. The first sidewall 63 and the second sidewall 64 are generally triangular structures, and the first sidewall 63 and the second sidewall 64 are hingedly coupled to a respective one of the canopy struts 11 at one corner. Each of the canopy roof corner pieces 6 is inclined outward and upward relative to the center of the folding canopy, and the outermost end of each of the canopy roof corner pieces 6 has an angular structure, which is convenient for fixing with the edge of the small roof tarpaulin. Generally, the number of canopy roof corner pieces 6 is consistent with the number of canopy struts 11, preferably four. The canopy roof corner pieces 6 cooperate with the small-roof upper disk member 4 to complete the supporting and unfolding of the small-roof tarpaulin, thus realizing the folding canopy with a double-roof structure.

According to the present invention, the opening and closing of the folding canopy is utilized, through optimized design, to drive the canopy struts to move by means of the small-roof lower disk member and the elevating rod, so that the elevating of the small-roof upper disk member is realized, and the unfolding of the small roof tarpaulin is completed with the canopy roof corner pieces, thereby realizing the automatic opening and closing of the double roofs of the folding canopy. In addition, the optimized structure can be used with the existing center lock structure to achieve reduced manufacturing cost and good universality.

It is apparent from the general technical knowledge that the present invention can be implemented by other embodiments without departing from the spirit or essential characteristics thereof. Therefore, the above-disclosed embodiments are merely illustrative, not exclusive, in all respects. All changes within the scope of the present invention or within the scope equivalent to the present invention are encompassed by the present invention.

What is claimed is:

1. A folding canopy with an automatic opening and closing center small-roof structure, comprising a plurality of canopy leg tubes and a folding canopy frame located above the canopy leg tubes, wherein the folding canopy frame comprises a plurality of canopy struts, one end of each of the canopy struts is hingedly coupled to a center roof disk, a small-roof upper disk member is provided above the center roof disk, a small-roof lower disk member is provided below the center roof disk, an elevating rod is provided between the small-roof lower disk member and the small-roof upper disk member, and the small-roof lower disk member is movable vertically along with the opening and closing of the folding canopy, such that the small-roof upper disk member is movable vertically by driving of the elevating rod, the folding canopy further comprising:

a plurality of linkage rods, wherein one end of each of the linkage rods is hingedly coupled to the small-roof lower disk member, and the other end of each of the linkage rods is hingedly coupled to a respective one of the canopy struts, wherein the elevating rod has a single rod structure, and is mounted to cooperate with a center of the small-roof lower disk member, a center of the center roof disk is provided with an elevating hole, and the elevating rod penetrates the elevating hole and is fixedly installed at a center of the small-roof upper disk member; and a center lower disk member, wherein the center lower disk is located below the small-roof lower disk member, and the elevating rod penetrates a first through hole at the center of the small-roof lower disk member and extends downwards, and a bottom end of the elevating rod is capable of being locked with the center lower disk.

2. The folding canopy with an automatic opening and closing center small-roof structure according to claim 1, wherein a slotted hole is provided in a middle portion of the small-roof lower disk member, and a bottom end of the elevating rod is embedded in the slotted hole and fixed by a fastener.

3. The folding canopy with an automatic opening and closing center small-roof structure according to claim 1, wherein the elevating rod is fixedly coupled to the small-roof lower disk member through a fastener, and the small-roof lower disk member is capable of driving the elevating rod to move vertically along with the opening and closing of the folding canopy, such that the small-roof upper disk member is movable vertically by the driving of the elevating rod.

4. The folding canopy with an automatic opening and closing center small-roof structure according to claim 1, wherein the canopy struts are respectively provided with canopy roof corner pieces, and the canopy roof corner pieces are configured for supporting edges of a small roof tarpaulin.

5. The folding canopy with an automatic opening and closing center small-roof structure according to claim 4, wherein each of the canopy roof corner pieces comprises a first sidewall, a second sidewall and an upper wall, a groove is formed between the first sidewall, the second sidewall and the upper wall, an opening of the groove faces downward, and the groove is configured for being embedded with a respective one of the canopy struts.

6. The folding canopy with an automatic opening and closing center small-roof structure according to claim 5, wherein the first sidewall and the second sidewall are triangular structures.

7. The folding canopy with an automatic opening and closing center small-roof structure according to claim 6, wherein a bottom corner of the first sidewall and a bottom corner of the second sidewall are hingedly coupled to the respective one of the canopy struts.

8. The folding canopy with an automatic opening and closing center small-roof structure according to claim 5, wherein the canopy roof corner pieces are inclined outward and upward relative to a center of the folding canopy.

9. The folding canopy with an automatic opening and closing center small-roof structure according to claim 1, wherein an upper end of the center roof disk is provided with an embedding groove configured for the small-roof upper disk member to be embedded within.

10. The folding canopy with an automatic opening and closing center small-roof structure according to claim 1, wherein a locking groove is provided in the small-roof lower disk member, and the locking groove is configured in cooperation with a fastener, and the fastener penetrates through the locking groove and is fixed with the elevating rod.

11. A folding canopy with an automatic opening and closing center small-roof structure, comprising a plurality of canopy leg tubes and a folding canopy frame located above the canopy leg tubes, wherein the folding canopy frame comprises a plurality of canopy struts, one end of each of the canopy struts is hingedly coupled to a center roof disk, a small-roof upper disk member is provided above the center roof disk, a small-roof lower disk member is provided below the center roof disk, an elevating rod is provided between the small-roof lower disk member and the small-roof upper disk member, and the small-roof lower disk member is movable vertically along with the opening and closing of the folding canopy, such that the small-roof upper disk member is movable vertically by driving of the elevating rod, the folding canopy further comprising:

a plurality of linkage rods, wherein one end of each of the linkage rods is hingedly coupled to the small-roof lower disk member, and the other end of each of the linkage rods is hingedly coupled to a respective one of the canopy struts, wherein the elevating rod comprises at least two elevating rod units, bottom ends of the elevating rod units are fixedly installed with the small-roof lower disk member, roof ends of the elevating rod units are fixedly installed with the small-roof upper disk member, and the center roof disk is provided with a plurality of elevating holes, and each elevating rod unit penetrates through a respective one of the elevating holes and is disposed in one-to-one correspondence.

12. The folding canopy with an automatic opening and closing center small-roof structure according to claim 11, further comprising a center lower disk, wherein the center lower disk is located below the small-roof lower disk member, and a center locking rod is fixedly installed on the center roof disk, and penetrates through a second through hole at a center of the small-roof lower disk member and extends downwards, and a bottom end of the center locking rod is capable of being locked with the center lower disk.

13. The folding canopy with an automatic opening and closing center small-roof structure according to claim 12, wherein the elevating rod units surround an outer side of the center locking rod, and the small-roof lower disk member slides up and down along the center locking rod during opening and closing with the folding canopy.

14. A folding canopy with an automatic opening and closing center small-roof structure, comprising a plurality of canopy leg tubes and a folding canopy frame located above the canopy leg tubes, wherein the folding canopy frame comprises a plurality of canopy struts, one end of each of the canopy struts is hingedly coupled to a center roof disk, a small-roof upper disk member is provided above the center roof disk, a small-roof lower disk member is provided below the center roof disk, an elevating rod is provided between the small-roof lower disk member and the small-roof upper disk member, and the small-roof lower disk member is movable vertically along with the opening and closing of the folding canopy, such that the small-roof upper disk member is movable vertically by driving of the elevating rod, wherein an upper end of the center roof disk is provided with an embedding groove configured for the small-roof upper disk member to be embedded within.

* * * * *